US011316241B2

(12) United States Patent
Ballandras et al.

(10) Patent No.: US 11,316,241 B2
(45) Date of Patent: Apr. 26, 2022

(54) ANTENNA CONNECTION, PARTICULARLY FOR SURFACE GUIDED ELASTIC WAVE TRANSDUCERS

(71) Applicant: FREC |N| SYS, Besançon (FR)

(72) Inventors: Sylvain Ballandras, Besançon (FR); Alexandre Raveski, Besançon (FR); Florent Bernard, Besançon (FR); Julien Garcia, Chamblay (FR); Emilie Courjon, Besançon (FR); Thierry LaRoche, Besançon (FR)

(73) Assignee: FREC |N| SYS, Besançon (FR)

( * ) Notice: Subject to any disclaimer, the term of this patent is extended or adjusted under 35 U.S.C. 154(b) by 0 days.

(21) Appl. No.: 16/497,427

(22) PCT Filed: Mar. 29, 2018

(86) PCT No.: PCT/IB2018/052217
§ 371 (c)(1),
(2) Date: Sep. 24, 2019

(87) PCT Pub. No.: WO2018/178941
PCT Pub. Date: Oct. 4, 2018

(65) Prior Publication Data

US 2020/0303804 A1 Sep. 24, 2020

(30) Foreign Application Priority Data

Mar. 30, 2017 (FR) ..... 1770318

(51) Int. Cl.
*H01Q 1/00* (2006.01)
*H01Q 1/12* (2006.01)
(Continued)

(52) U.S. Cl.
CPC ..... *H01Q 1/002* (2013.01); *H01Q 1/1207* (2013.01); *H01Q 1/22* (2013.01); *H01Q 9/16* (2013.01); *H01R 4/30* (2013.01)

(58) Field of Classification Search
CPC ..... H01Q 1/002; H01Q 1/1207; H01Q 9/16; H01Q 1/22; G01K 11/265; H01R 2201/02; H01R 4/30; H03H 9/058
(Continued)

(56) References Cited

U.S. PATENT DOCUMENTS

2003/0107881 A1* 6/2003 Muramatsu ..... H01Q 1/1207 361/818
2004/0263397 A1* 12/2004 Noro ..... H01Q 21/24 343/702
(Continued)

FOREIGN PATENT DOCUMENTS

CN 205843840 U 12/2016
FR 2989825 B1 6/2014

OTHER PUBLICATIONS

International Search Report for International Search Report for International Application No. PCT/IB2018/052217 dated Jul. 13, 2019, 3 pages.
(Continued)

*Primary Examiner* — Andrea Lindgren Baltzell
*Assistant Examiner* — Yonchan J Kim
(74) *Attorney, Agent, or Firm* — TraskBritt

(57) ABSTRACT

An electrical device adapted to operate at a high operating ambient temperature includes an electrical component mounted inside a casing, a transmission/reception antenna and at least one electrical and mechanical connection between the electrical component and the antenna. The electrical and mechanical connection comprises a metal pad positioned under the casing, the antenna being connected to
(Continued)

the pad; an electrical connection tab having a first end connected to the electrical component; and fixing means adapted to secure the pad and a second end of the connection tab of the component. The device is applicable to, for example, temperature sensors of the surface guided elastic wave type.

16 Claims, 2 Drawing Sheets

(51) Int. Cl.
*H01Q 1/22* (2006.01)
*H01Q 9/16* (2006.01)
*H01R 4/30* (2006.01)

(58) Field of Classification Search
USPC ..... 310/321, 324, 346; 343/872
See application file for complete search history.

(56) References Cited

U.S. PATENT DOCUMENTS

2007/0024505 A1* 2/2007 Geisheimer ..... H01Q 1/42 343/700 MS
2008/0165067 A1* 7/2008 Kim ..... H01Q 1/243 343/702
2009/0051246 A1* 2/2009 Mueller ..... H01L 41/053 310/313 R
2012/0127054 A1* 5/2012 Portier ..... H01Q 1/1207 343/834
2013/0077222 A1 3/2013 Sleven
2017/0025767 A1* 1/2017 Elsallal ..... H01Q 3/30
2018/0069588 A1* 3/2018 Jiang ..... G06F 1/163

OTHER PUBLICATIONS

International Written Opinion for International Search Report for International Application No. PCT/IB2018/052217 dated Jul. 13, 2019, 8 pages.

* cited by examiner

ANTENNA CONNECTION, PARTICULARLY FOR SURFACE GUIDED ELASTIC WAVE TRANSDUCERS

CROSS-REFERENCE TO RELATED APPLICATIONS

This application is a national phase entry under 35 U.S.C. § 371 of International Patent Application PCT/IB2018/052217, filed Mar. 29, 2018, designating the United States of America and published as International Patent Publication WO 2018/178941 A1 on Oct. 4, 2018, which claims the benefit under Article 8 of the Patent Cooperation Treaty to French Patent Application Serial No. 17/70318, filed Mar. 30, 2017.

TECHNICAL FIELD

The present disclosure relates to the field of electrical devices designed to operate at high-operating ambient temperatures, of 300° C. or more. A preferred application of the electrical device of the present disclosure relates to remotely measuring physical quantities, e.g., remotely measuring temperature, in environments having high ambient temperatures, by using, in particular, Surface Acoustic Wave (SAW) temperature sensors.

BACKGROUND

Such sensors are "autonomous" or "stand-alone" in the sense that they communicate with the outside and receive energy from the outside via electromagnetic waves that are detected and transmitted by means of an antenna integrated in the sensor. Particular attention must therefore be paid to the antenna connection, firstly for limiting to a maximum the radiofrequency losses of the sensor, and secondly for electrically and mechanically withstanding temperatures in excess of 300° C.

Document FR 2 989 825 describes a technique for connecting together two electrical components, that technique consisting in electrically connecting together the fastening tabs of the two components via a solder joint, the melting temperature of the solder being less than the temperature at which the component is usually used, and then in covering the solder joint with a dome of cement that is a sealant and that withstands temperature. During use at a high temperature, the solder joint can melt, but the liquid solder remains confined within the dome of cement so that the electrical connection is maintained.

Unfortunately, that type of connection suffers from drawbacks. Experience has shown that it is particularly complex to form a dome of cement that adheres fully to the very specific supports of SAW sensors, in particular, if the dome is to have dimensions of the order of a few millimeters (mm), as it is for an antenna in which the fastening tab has a thickness of about 1 mm or more. Experience has also shown that such a connection ages poorly and loses its effectiveness as the number of melting/solidifying cycles of the solder joint increases.

An object of the present disclosure is to propose an electrical device in which the components are connected together electrically via electrical connection means using a technique that is an alternative to the above-described technique, withstanding high temperatures, and adapted to connecting together passive components, in particular, surface acoustic wave or surface elastic wave passive components disposed on substrates of the single-crystal type or of the composite type (piezoelectric layers or films deposited on or transferred to substrates).

BRIEF SUMMARY

To this end, the present disclosure provides a novel electrical device suitable for operating at an operating ambient temperature of higher than 300° C., the device comprising a casing, an electrical component mounted inside the casing, a transmission/reception antenna positioned outside the casing, and at least one electrical and mechanical connection between the electrical component and one pole of the antenna, the electrical and mechanical connection comprising:

- a metal pad, the connection surface of which is positioned against an outside surface of the casing, the pole of the antenna being connected to the pad;
- an electrical connection tab having a first end connected to the electrical component; and
- fixing means adapted to secure together the pad, the casing, and a second end of the connection tab of the component.

Thus, in a device of the present disclosure, the pole of the antenna of the electrical component is connected via a metal pad positioned under the casing of the device, which casing is generally electrically insulating. The pad is a strong metal part that withstands heat to a much greater extent than a conventional solder joint.

Also, for electrical components of the SAW type, the metal pad constitutes an electric charge reserve that improves operation of the antenna. Finally, in the particular situation of an electrical component of the temperature sensor type, the metal pad makes it possible to achieve good heat transfer between the part of which the temperature is measured and the sensor so that the accuracy of the measured temperature is high.

The pad is preferably provided with a groove opening out into a clearance surface of the pad, which groove is adapted to receive a fastening end of the pole of the antenna. By means of the groove in the pad, the electrical and mechanical connection between the pad and the fastening end of the pole of the antenna is much easier to achieve than by using soldering, in particular, when an antenna pole or the fastening end is of cross-section and of dimensions smaller than one millimeter, as described below in examples.

The pad may also be provided with a bearing surface arranged so that the pad forms a foot or a leg for the casing. The pad may thus serve as a support for the casing. The bearing surface may be covered with an electrically insulating covering. This option is advantageous, in particular, for electrical devices designed to be positioned on a metal object and for which the metal pad serves as a support, the electrically insulating covering avoiding grounding the antenna.

The fastening end of the pole of the antenna may be inserted into the groove via an opening in the groove that opens out into one of the side faces of the pad. In a variant, the groove is also open over the connection surface of the pad, so as to facilitate putting the fastening end of the pole of the antenna in place in the groove of the pad.

The fastening end of the pole of the antenna may be adhesively bonded to the inside of the groove, so as to prevent it from being pulled out of the groove; for example, a conductive adhesive filled with metal particles may be used for achieving the electrical contact. A cross-section of the groove may also be smaller, at least locally, than a cross-section of the fastening end of the pole of the antenna. The fastening end of the pole of the antenna is thus in tight-fitting contact at least locally in the groove, thereby firstly preventing the pole of the antenna from being pulled out and secondly procuring good electrical contact between the pad and the pole of the antenna. The fastening end of the pole of the antenna can also be terminated by an anchoring head of cross-section and/or of shape different from the cross-section and/or the shape of the fastening end of the pole of the antenna. The anchoring head makes it possible to prevent the pole of the antenna from being pulled out by traction being exerted on the antenna. A cross-section and/or a shape of the groove of the pad is adapted to fit the cross-section and/or the shape of the fastening end of the antenna so that the fastening tab is held stationary in the groove. The fastening end of the antenna pole and the groove may be provided with threads; the fastening end of the antenna pole may then be screwed into the groove to fasten it mechanically to the pad and to procure the electrical contact between the antenna pole and the pad.

In another embodiment, the pad and the antenna pole are formed in one piece, e.g., by machining a block of metal. Naturally, the groove is not necessary in this situation, the electrical and mechanical contact between the antenna pole and the pad being guaranteed by the mode of manufacturing.

In an embodiment of the electrical device of the present disclosure:

- the pad is provided with a hole;
- the casing is provided with a hole whose axis is an extension of a longitudinal axis of the hole in the pad; and
- the fixing means comprises a screw that cooperates with the hole in the casing to connect the connection tab of the electrical component and the pad to the casing electrically and mechanically.

In another embodiment of the electrical device of the present disclosure, the pad is provided with a pin extending from the connection surface of the pad, a free end of the pin being adapted for:

- cooperating with fixing means of the nut type or of the retaining pin type; or
- being crimped for forming fixing means of the rivet type.

In yet another embodiment of the device of the present disclosure, the groove of the pad is open on a surface of the pad that is distinct from the connection surface and that is distinct from the clearance surface, wherein the pad is provided with a hole opening out into the groove and the casing is provided with a hole, the axis of which is in alignment with the axis of the hole in the pad, wherein the distal portion of the fastening end of the pole of the antenna is bent to form a pin, and wherein the pin is adapted to pass through the hole in the pad, to pass through the hole in the casing, and to extend into the casing when the fastening end of the pole of the antenna is engaged in the groove, a free end of the pin being adapted for:

- cooperating with fixing means of the nut type or of the retaining pin type; or
- being crimped for forming fixing means of the rivet type.

In the above embodiments, the electrical and mechanical connection between the pad and the connection tab for connection to the electrical component is implemented by one or more metal elements (screws, pins, etc.) that have excellent resistance to high temperatures.

In yet another embodiment, an electrical device of the present disclosure may further comprise a second metal pad of which a connection surface is positioned against the outside surface of the casing, the second pad forming a ground for the monopole antenna or being arranged to be connected to a ground that is external to the electrical device. In this case, the pad to which the monopole antenna is fastened may have a bearing surface covered with an insulating covering. The second pad may be of dimensions different from the dimensions of the first pad to which the antenna pole is fastened.

In yet another embodiment, a device of the present disclosure may comprise a transmission/reception antenna having two poles (or a "dipole antenna") and at least two electrical and mechanical connections, each of which connecting the electrical component to one of the poles of the antenna, each electrical and mechanical connection comprising:

- a metal pad, a connection surface of which is positioned against the outside surface of the casing, the associated pole of the antenna being connected to the pad, the pads of the two electrical and mechanical connections being distinct from each other;
- a connection tab having a first end connected to the electrical component; and
- fixing means adapted to secure the pad and a second end of the connection tab of the component to the casing.

The use of two distinct pads, one for each dipole of the antenna, makes it possible to insulate the dipoles electrically from each other.

In addition, the pads of the two electrical and mechanical connections may be separated by a spacer made of an electrically insulating material. Also, an inductive or capacitive impedance may be connected between the pads of the two electrical connections. These elements make it possible to adjust an input impedance of the dipole antenna. The inductive or capacitive impedance may advantageously be made of metal materials capable of withstanding high temperatures, greater than 300° C. (alloyed stainless steel of the Inconel® type, molybdenum, other alloys based on chromium or on nickel, or indeed noble metals such as gold or platinum).

BRIEF DESCRIPTION OF THE DRAWINGS

The present disclosure will be better understood, and other characteristics and advantages of the present disclosure will appear on reading the following description of an embodiment of a device of the present disclosure. This embodiment is given by way of non-limiting example. The description should be read with reference to the accompanying drawings, wherein.

DETAILED DESCRIPTION

Figure 1:
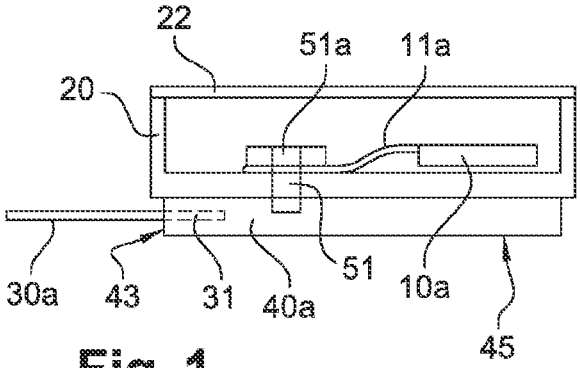
FIG. 1 is a diagrammatic vertical section view of the essential elements of an electrical device according to the present disclosure.
Figure 5:
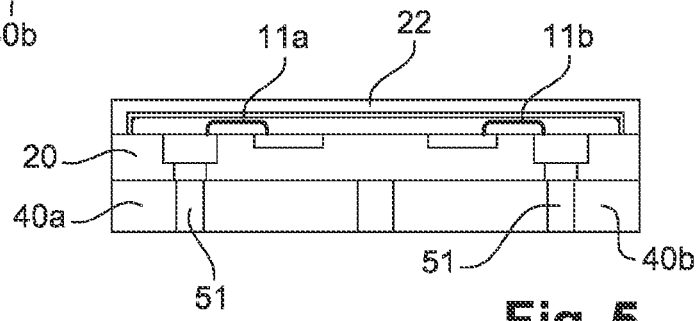
FIG. 5 is a vertical section view of the device shown in FIGS. 2 and 3.
Figure 4A:
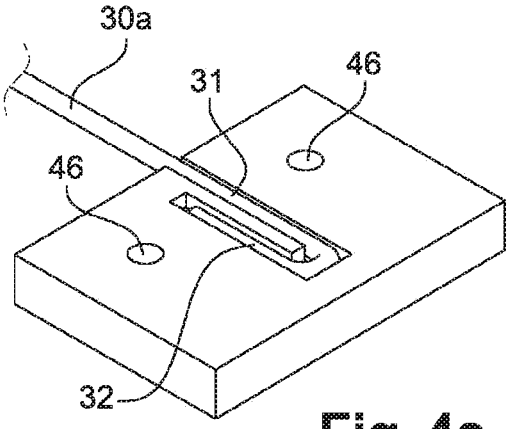
FIG. 4*a* is a perspective view of an essential element of the electrical device shown in FIGS. 2 and 3.
Figure 4B:
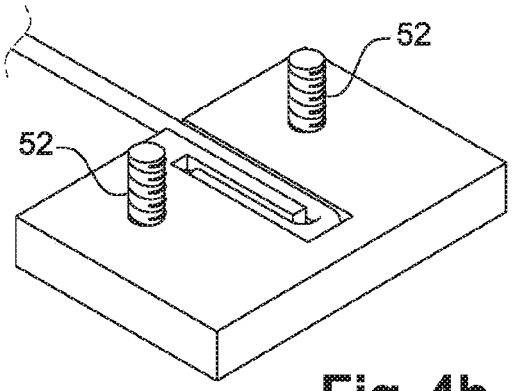
FIGS. 4*b* and 4*c* are variant embodiments of the element of FIG. 4*a*, as seen in section.
Figure 4C:
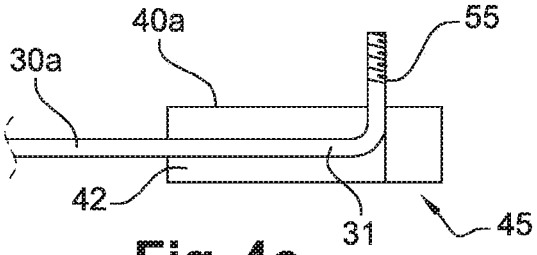

A device of the present disclosure is portable, and movable at will, and, under the conditions of use being considered, it is merely placed on a support extending in a substantially horizontal plane. Thus, in the above, and in the description below (and unless otherwise indicated locally) the geometric reference frames and the terms defined as follows are used:

- a vertical axis is a longitudinal axis on the sheets of drawings;
- the horizontal plane is a contact plane in which a pad comes into contact with the support when the device of the present disclosure is being used, the horizontal plane being perpendicular to the vertical axis;
- FIGS. 1 and 5 are views in section on a vertical plane corresponding to the plane of the sheets of drawings; and
- for the embodiments shown in FIGS. 1 to 5, the terms "bottom", "under", "top", "above", "side", and "front" are defined for an electrical device being used on the horizontal support, i.e., when the pads are laid flat and in contact with the horizontal support.

Naturally, these conventions merely indicate reference frames that facilitate the description and do not prevent the device of the present disclosure from being used in any other position.

As mentioned above, the present disclosure relates to an electrical device adapted to operate at a high-operating ambient temperature, in particular, at a temperature higher than 300° C.

FIG. 1 diagrammatically shows the essential elements of an electrical device according to the present disclosure, the device comprising a casing 20, an electrical component 10*a* mounted inside the casing 20, a transmission/reception antenna comprising one pole 30*a*, and at least one electrical and mechanical connection between the electrical component and the pole of the antenna, which electrical connection comprises:

- a metal pad 40*a*, the connection surface 44 of which is positioned against an outside surface of the casing, the pole of the antenna being connected to the pad;
- an electrical connection tab 11*a*, 11*b* having a first end connected to the electrical component; and
- fixing mean 51 adapted to secure together mechanically the pad, the casing, and a second end of the connection tab of the component;

The transmission/reception antenna is positioned outside the casing. More precisely, the antenna pole is connected to the pad but it is in direct mechanical contact with the casing, nor is it with the connection tab.

In the example shown in FIG. 1, the pad is positioned under the casing so that the connection surface 44 of the pad corresponds to the top surface of the pad.

In this example, the fixing means are constituted by an electrically conductive screw 51; the second end of the connection tab of the component is clamped between the head 51*a* of the screw and the casing, thereby not only mechanically fastening the second end of the connection tab to the casing but also electrically connecting the screw to the fastening tab of the component; the distal end of the screw 51 is anchored in the pad, ensuring not only mechanically fastening the pad to the casing, abut also electrically connecting the pad to the screw.

FIGS. 2, 3, 4 and 5 show another embodiment of a device according to the present disclosure, which device comprises two electrical components and a dipole antenna. More precisely, in this example, the device comprises:

- a casing 20;
- two electrical components 10*a*, 10*b;*
- two connection tabs 11*a*, 11*b;*
- a dipole transmission/reception antenna, comprising two poles 30*a*, 30*b;*
- two distinct pads 40*a*, 40*b*, each of which is associated with a respective one of the poles 30*a*, 30*b* of the antenna; and
- fixing means 51.

In an embodiment, the casing has a surface area of the order of 1 centimeter (cm)×2.5 cm and a thickness of the order of 1.2 mm, and it is made of an electrically insulating material. The casing is closed by a lid 22. The electrical components 10*a*, 10*b* are, in this example, surface acoustic wave temperature sensors adhesively bonded to the bottom of the casing 20. In a variant, the casing is made of a material of the single-crystal type on which the components are formed directly using known layer deposition techniques.

The component 10*a* is connected at a plurality of points to a first equipotential track 12*a* via heat-bonded electrical connection wires. Similarly, the component 10*b* is connected at a plurality of points to a second equipotential track 12*b* via electrical connection wires. A connection tab 11*a* has a first end bonded to the equipotential track 12*a* and a second end bonded to a head 51*a* of a screw 51. The connection tab 11*a* thus forms an electrical connection between the component 10*a* and the screw 51 via the equipotential track 12*a*. Similarly, a connection tab 11*b* forms an electrical connection between the component 10*b* and another screw 51 via the equipotential track 12*b*. In the example implemented, the connection tabs 11*a*, 11*b*, and the connection wires for connecting a component to an equipotential track 12*a*, 12*b* are made of gold wire of a diameter of 35 micrometers (μm).

It should be noted that, in the example shown, the equipotential tracks 12*a*, 12*b* make it possible to connect each of the components 10*a*, 10*b* at a plurality of points to the same potential, which potential is present on one of the screws 51. Naturally, if a single connection to the same potential is sufficient for an electrical component, the equipotential tracks are not essential, and the first ends of the connection tabs 11*a*, 11*b* are then connected directly to the components 10*a*, 10*b*.

In the example shown, each pole 30*a*, 30*b* of the antenna is of filiform shape, i.e., in the shape of a wire or rod that is straight, and that is of circular cross-section of area of approximately of the order of 0.2 square millimeters ($mm^2$) to 1 $mm^2$. Other forms and shapes of poles of antenna are possible, depending on the conditions under which the device is to be used, e.g., a filiform or wire dipole in the shape of a loop, of a spiral, etc., or indeed a filiform or wire shape of flat cross-section. For example, the poles of the antenna are made of an alloy of the Inconel® type. Such alloys offer the advantage of withstanding temperatures of up to 800° C., some of these alloys being capable of withstanding 1,000° C. depending on the nature of their component alloyed elements.

In the example shown, a pole 30*a* or 30*b* is terminated by a fastening end 31, a distal portion of which is, in this example, hook-shaped so as to form an anchoring head 32. Other shapes of anchoring head may be considered, e.g., a ball of diameter greater than a radius of the cross-section of the fastening end 31 of the pole, or a cylindrical portion of cross-section larger than a cross-section of the fastening end 31. An anchoring head should merely have a cross-section and/or a shape different from the cross-section and/or the shape of the fastening end 31 of a pole of the antenna so as to prevent the pole of the antenna from being pulled out. The anchoring of the pole may optionally be reinforced using an adhesive, advantageously made conductive by including fine conductive particles (e.g., silver paste) for improving the mechanical and electrical connections between the pole and the pad.

In the examples shown in FIGS. 1 to 5, the pads 40*a*, 40*b* are of substantially rectangular block shape, and of small thickness, e.g., of thickness approximately in the range 1 mm to 2 mm. The two pads are positioned side-by-side under the casing, without however touching each other, so that the two pads are electrically insulated from each other. The two poles of the antenna are thus electrically insulated from each other.

As a function of the applications considered, the device shown in FIGS. 2 to 5 may be modified. The gap between the two pads may optionally be filled with a spacer (not-shown) made of an electrically insulating material. Also, an inductive or capacitive impedance (not shown) may be connected between the pads 40*a*, 40*b* so as to adjust an input impedance of the dipole antenna.

The pads may also serve as feet or legs for the casing, and come to bear against the support. The bearing faces of the pads (i.e., the bottom faces 45 of the pads in the example of FIGS. 2 to 5) may be covered with electrically insulating coverings or coatings (not shown).

In the example shown in FIGS. 2 to 5, each of the pads 40*a*, 40*b* is provided with a groove 42 opening out in a clearance face of the pad (in this example, the clearance face is a side face 43 of the pad); the groove has a shape adapted to receive a fastening end 31 of a pole of the antenna. In this example, a cross-section of the groove is locally slightly smaller than a cross-section of the fastening end of an antenna pole; thus, the fastening end is force fitted into the groove, at least locally, thereby procuring good electrical contact between the fastening end of the antenna and the associated pad. In a variant, the fastening end may be adhesively bonded into the groove 42 by means of an electrically conductive adhesive.

More particularly, in the example shown, the groove 42 has a substantially cylindrical shape, of axis substantially parallel to a top face 44 of the pad, and of diameter substantially equal to the diameter of the filiform or wire fastening tab of a pole of the antenna; the innermost end (distal end) of the groove is curved so as to receive the hook-shaped distal portion of the fastening end 31 of a pole of the antenna. In this example, the groove 42 is also open over the top face 44 of the pad. Thus, the filiform or wire pole fastened to the pad extends substantially parallel to the casing.

In the example shown, each pad 40*a* 40*b* is provided with two holes 46 of substantially vertical axis. The casing 20 is also provided with four holes 21*a*, 21*b*, an axis of a hole 21*a*, 21*b* being an extension of the axis of a respective hole 46 in a pad 40*a*, 40*b*. In the bottom of the casing, at the tops of the holes 21*a*, 21*b*, recessing or countersinking is performed to receive the heads of the screws so that they flush with the bottom of the casing. In the example shown, the holes 46 in the pads are tapped, i.e., provided with threads, and the screws 51 are organized to secure the pads 40*a*, 40*b* to the casing 20, after the fastening ends 31 of the poles 30*a*, 30*b* have been put in place in the grooves 42 in the pads. In a variant, the holes 46 may be through holes that open out under the corresponding pad, the screws 51 then passing through the corresponding pad and a nut then being associated with the screw to secure the pad mechanically to the casing.

Figure 2:
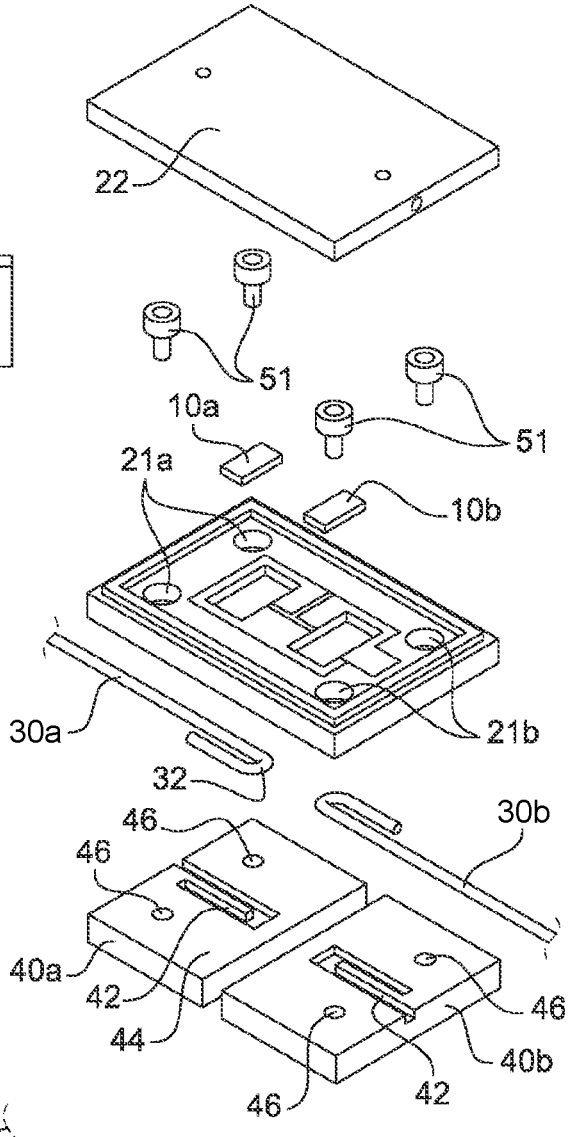
FIG. 2 is an exploded perspective view of an electrical device implemented in accordance with the present disclosure.
Figure 3:
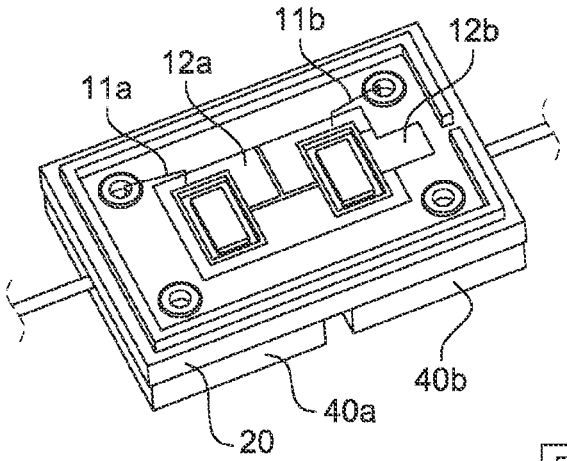
FIG. 3 is a perspective view of the device of FIG. 2 as assembled.

Also in the example shown, in order to implement an electrical connection between a component and a pad, the connection tab 11*a* or 11*b* is a filiform or wire tab, and the second end of the tab is bonded to the head 51*a* of a screw 51 (FIGS. 2-3). In a variant, a connection tab 11*a* or 11*b* is a filiform or wire tab and the second end of the tab is hook-shaped and is positioned under head the 51*a* of a screw 51 (FIG. 1): the second end is thus clamped between the screw head and the casing when the screw is tightened. In another variant (not shown), a connection tab 11*a* or 11*b* is an electrical track or flat ribbon, the first end of which is secured to a component or to an equipotential track 12*a*, 12*b*, and the second end of which is provided with an orifice adapted to enabling the shank of the screw 51 to pass through it: the second end can thus be clamped between the screw head and the casing when the screw is tightened.

The electrically conductive screws 51 pass through a hole in the casing and cooperate with the corresponding hole 46 in a pad for the purposes of mechanically securing a connection tab 11*a*, 11*b* of the electrical component and a pad to the casing, and of electrically connecting the connection tab for a connection to the pad.

Naturally, the device of FIGS. 2, 3, and 5 is merely one example of a device of the present disclosure. Other implementations are conceivable, the important thing being to connect the antenna mechanically and electrically to the electrical component.

A device of the present disclosure may have a single electronic component only. The one or more electronic components may be of any type, and not merely volume wave or surface guided wave sensors, and not merely temperature sensors. The same component may have one or more connection tabs for connection to potentials that may be different or the same.

In the example shown in FIGS. 2 to 5, the fastening end of the antenna pole is curved back to receive the hook-shaped distal portion of the fastening end 31 of an antenna pole. In another embodiment (not shown in the figures), the antenna pole is rectilinear, and the fastening end 31 of the antenna pole and the groove are provided with threads; the fastening end of the antenna pole is then screwed into the groove to fasten it mechanically to the pad and to provide the electrical contact between the antenna pole and the pad. In another embodiment, the pad and the antenna pole are formed in one piece, e.g., by machining a block of metal. Naturally, the groove is not necessary in this situation, the electrical and mechanical contact between the antenna pole and the pad being guaranteed by the mode of manufacturing.

In this example, two screws 51 are used for each pad 40*a*, 40*b*. In practice, a single screw 51 suffices to provide the mechanical and electrical connection between the pad and the connection tab 11*a*, 11*b*. Also, the screw 51 may be replaced by a screw and nut system; recessing or countersinking may also be provided in the bottom of the casing and/or under the pad for receiving the screw head and/or the nut.

Also, instead of the screws 51, it is possible to implement a pad having a pin 52 that is of substantially vertical axis and that extends from the top face of the pad (FIG. 4*b*); the pin 52 replaces the shank of the screw, and passes through the hole 21*a* in the casing; the free end of the pin 52 extending into the casing may then, as chosen, either cooperate with locking means of the nut or retaining pin type (which means are not shown) or be crimped to form a rivet (not shown), the second end of the connection tab 11*a*, 11*b* of the component naturally being pinched or bonded to the end of the pin 52, of the nut, of the retaining pin, etc. in order to provide the connection between the component and the pin 52.

In a variant, also instead of the screws 51, it is possible to bend the distal portion of the fastening end of an antenna dipole to form a pin 55 (FIG. 4*c*); an opening is then provided for the groove 42 in a bottom face 45 of the pad so as to enable the fastening end to be put in place in the groove and so as to enable the pin-shaped distal portion defining the pin 55 to be put in place in the hole 46 in the pad. As in the preceding variant, the free end of the pin 55 extending into the casing can then, as chosen, either cooperate with locking means of the nut or retaining pin type (which means are not shown) or be crimped to form a rivet (not shown).

A prototype was made, as shown in FIGS. 2, 3, 4*a*, 4*b*, and 5, for an electrical component of the temperature sensor type. For such an application, the metal pads were thus positioned under the casing and the shape of the pads was optimized so as to have as large a bearing surface area 45 as possible, for optimized heat transfer between the electrical component and the support of which the temperature is to be measured.

But the position(s) of the pad(s) relative to the casing and the overall shape(s) of the pad(s) may naturally be optimized as a function of the applications considered and of the constraints related to the applications.

Figure 6A:
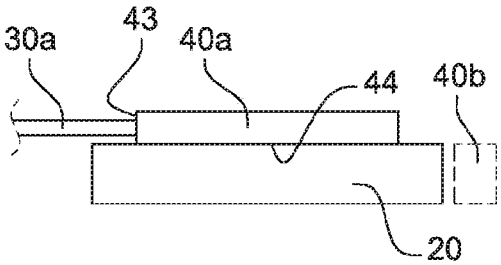
FIGS. 6*a*, 6*b*, and 6*c* show other embodiments of the present disclosure, seen from the front.

For example, in FIG. 6*a*, a monopole antenna is used and the pad associated with the pole of the antenna is positioned above the casing; in this example, the connection surface 44 of the pad corresponds to the bottom face of the pad, and the clearance surface 43 of the pad corresponds to a side face of the pad; the casing is used as placed directly in contact with the support. The heat transfer is thus maximal and the antenna is electrically insulated from the support without an insulating covering or coating being necessary. If a ground is necessary, a second metal pad (shown in dashed lines in FIG. 6*a*) may be added under the casing or on one of the sides of the casing.

Figure 6B:
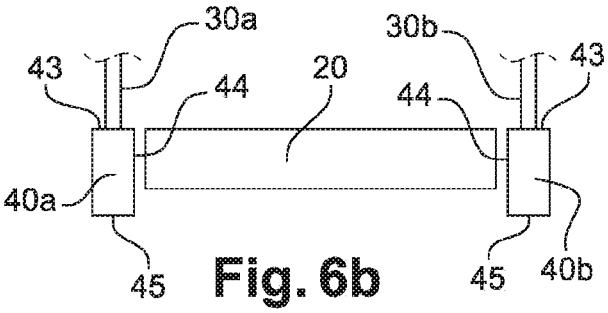
Figure 6C:
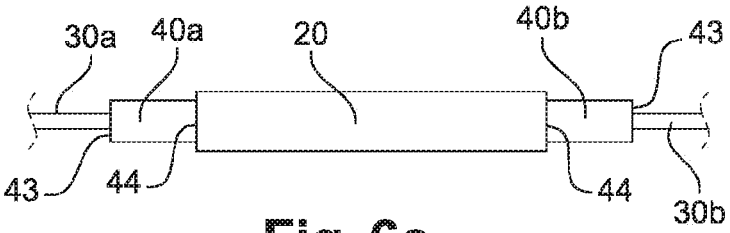

In the example shown in FIGS. 6*b* and 6*c*, a dipole antenna is used, and the two associated pads are positioned on opposite sides on the casing (connection surfaces 44 on the sides of the pads). The contact of the electrical device with its support is then minimal, being limited to the bearing surface area of the bottom face 45 of the pads, which surface area may be very small, in particular, relative to the preceding examples. The poles of the antenna may extend either vertically (clearance surfaces 43 on the tops of the pads, as shown in FIG. 6*b*) so as to limit the width of the pads, or in alignment with a main plane of the casing (clearance surfaces 43 on the tops of the pads, as shown in FIG. 6*c*) so as to limit the overall thickness of the device.

The invention claimed is:

1. An electrical device suitable for operating at an operating ambient temperature of higher than 300° C., the device comprising:

a casing;

an electrical component mounted inside the casing;

a transmission/reception antenna positioned outside the casing; and at least one electrical and mechanical connection between the electrical component and a pole of the transmission/reception antenna, the electrical and mechanical connection including:

a metal pad having a connection surface positioned against a surface of the casing, the pole of the transmission/reception antenna being connected to the metal pad;

an electrical connection tab having a first end connected to the electrical component; and a fixing device securing together the metal pad, the casing, and a second end of the electrical connection tab; and wherein the metal pad includes a groove extending to a clearance surface of the metal pad, a fastening end of the pole of the transmission/reception antenna disposed in the groove.

2. The electrical device of claim 1, wherein the metal pad comprises a bearing surface on a side thereof opposite the casing.

3. The electrical device of claim 2, wherein the bearing surface is covered with an electrically insulating covering.

4. The electrical device of claim 1, wherein the groove extends into the connection surface of the metal pad.

5. The electrical device of claim 4, wherein an end of the pole of the transmission/reception antenna comprises an anchoring head having a cross-section size and/or shape different from a cross-section size and/or shape of a remainder of the pole of the transmission/reception antenna.

6. The electrical device of claim 5, wherein an interference fit is provided between the groove and the pole of the transmission/reception antenna.

7. The electrical device of claim 6, wherein:

the metal pad comprises a first hole;

the casing includes a second hole axially aligned with the first hole in the metal pad; and the fixing device comprises a screw that cooperates with the second hole in the casing to electrically and mechanically connect the electrical connection tab and the metal pad to the casing.

8. The electrical device of claim 1, wherein the metal pad includes a pin extending from the connection surface of the metal pad, a free end of the pin being adapted for:

cooperating with a nut or a retaining pin; or being crimped to form a rivet.

9. The electrical device of claim 1, wherein the groove of the metal pad is open on a surface of the metal pad that is distinct from the connection surface and that is distinct from the clearance surface, wherein the metal pad includes a first hole extending to the groove, and the casing includes a second hole axially aligned with the first hole in the metal pad, wherein a distal portion of the pole of the transmission/reception antenna is bent to form a pin, and wherein the pin is adapted to pass through the first hole in the metal pad, to pass through the second hole in the casing, and to extend into the casing when an end of the pole of the transmission/reception antenna is engaged in the groove, a free end of the pin being adapted for:

cooperating with a nut or a retaining pin; or being crimped to form a rivet.

10. The electrical device of claim 2, further comprising a second metal pad having a connection surface positioned against a surface of the casing, the second metal pad forming a ground for the transmission/reception antenna or being arranged to be connected to a ground that is external to the electrical device.

11. The electrical device of claim 1, wherein the transmission/reception antenna includes two poles, and further comprising at least two electrical and mechanical connections, each of which connects the electrical component to one of the poles of the transmission/reception antenna, each electrical and mechanical connection comprising:

a metal pad having a connection surface positioned against a surface of the casing, the associated pole of the transmission/reception antenna being connected to the metal pad, the metal pads of the two electrical and mechanical connections being distinct from each other;

an electrical connection tab having a first end connected to the electrical component; and a fixing device securing the metal pad and a second end of the electrical connection tab to the casing.

12. The electrical device of claim 11, wherein the metal pads of the two electrical and mechanical connections are separated by a spacer comprising an electrically insulating material.

13. The electrical device of claim 11, wherein an inductive or capacitive impedance is connected between the metal pads of the two electrical connections.

14. The electrical device of claim 1, wherein an end of the pole of the transmission/reception antenna comprises an anchoring head having a cross-section size and/or shape different from a cross-section size and/or shape of a remainder of the pole of the transmission/reception antenna.

15. The electrical device of claim 1, wherein an interference fit is provided between the groove and the pole of the transmission/reception antenna.

16. The electrical device of claim 1, wherein:

the metal pad comprises a first hole;

the casing includes a second hole axially aligned with the first hole in the metal pad; and the fixing device comprises a screw that cooperates with the second hole in the casing to electrically and mechanically connect the electrical connection tab and the metal pad to the casing.

* * * * *